United States Patent [19]

Kinsey

[11] Patent Number: 4,687,406

[45] Date of Patent: Aug. 18, 1987

[54] LOAD LIFTING APPARATUS WITH OVERTURNING PREVENTION MEANS

[75] Inventor: Robert Kinsey, Nottingham, England

[73] Assignee: Kombilift Limited, Great Britain

[21] Appl. No.: 852,160

[22] Filed: Apr. 15, 1986

[30] Foreign Application Priority Data

Apr. 20, 1985 [GB] United Kingdom ..... 8510145

[51] Int. Cl.[4] ..... B66F 9/00

[52] U.S. Cl. ..... 414/701; 414/718; 414/719; 212/151; 212/154

[58] Field of Search ..... 414/718, 719, 699, 701, 414/680; 212/151, 154

[56] References Cited

U.S. PATENT DOCUMENTS

| | | | |
|---|---|---|---|
| 3,738,522 | 6/1973 | Cecchi | 414/701 |
| 3,792,792 | 2/1974 | Bromberek et al. | 414/701 X |
| 3,929,245 | 12/1975 | Inoue | 414/701 |
| 4,598,829 | 7/1986 | Young et al. | 212/151 X |

FOREIGN PATENT DOCUMENTS

| | | |
|---|---|---|
| 1182070 | 2/1970 | United Kingdom . |
| 1261804 | 1/1972 | United Kingdom . |
| 1403046 | 8/1975 | United Kingdom . |

*Primary Examiner*—Robert J. Spar
*Assistant Examiner*—Jay I. Alexander
*Attorney, Agent, or Firm*—Leydig, Voit & Mayer

[57] ABSTRACT

Load lifting apparatus comprises an extensible boom carrying a platform at its outer end and being pivotally mounted at its inner end on rotatable support structure. Hydraulic elevating and extending rams effect elevation and extension of the boom. The elevating ram acts at its bottom end on the support structure through a pivot arm which is seated at its free end on a spring pack. The coupling of the ram to the pivot arm preferably lies in the plane of the pivot axes of the arm and the boom, whereby the load on the spring pack can be independent of the boom elevation for a constant overturning moment of the boom. Hydraulic diverter valves, actuated by the pivot arm when it is deflected against the spring pack, operate to divert fluid flows from the elevating and/or extending rams to urge retraction of the boom upon a predetermined overturning moment being exceeded.

7 Claims, 8 Drawing Figures

LOAD LIFTING APPARATUS WITH OVERTURNING PREVENTION MEANS

Engine size in a self-propelled lifting platform is largely determined by the overall weight of the machine and the required road performance. To keep fuel costs down, engine size should not be greater than necessary. In order to reduce the required engine size for a certain road performance, or in order to achieve an improvement in road performance for a given engine size, it is desirable that the overall weight of the machine be minimised.

It can further be desirable to reduce engine size in order more nearly to match power requirements for the two conditions of operation of a self-propelled lifting platform, i.e. when operating as a vehicle and stationary when operating as an access platform; by doing this the engine can at all times be run at a power level which prevents the engine running cold for long periods and, therefore, allows it to run more efficiently. Reducing the overall weight of the machine can also have considerable advantages with regard to transportability to sites.

However, a reduction in weight of the machine base (i.e. including the engine and chassis, and those parts of the machine supporting the boom) results in a reduction in stability of the machine. More specifically, the maximum overturning moment which can safely be accepted on the machine base, from a loaded boom in use, becomes reduced.

The overturning moment applied to the machine base depends fundamentally on the load applied at the outer end of the boom (i.e. on the platform) and the horizontal outreach of the boom; a reduction in the overturning moment can be achieved by reducing the load and/or the outreach. The outreach varies, of course, with the elevation of the boom. In the case of an extensible boom machine, the outreach is determined not only by the boom elevation but also by the amount the boom is extended.

Accordingly, if the safely acceptable overturning moment is reduced, by reducing the weight of the machine base, one has to (a) reduce the safe working load, or (b) reduce the boom length or maximum permissible boom extension (which reduces the maximum outreach, and also reduces the available working height), or (c) make provision for monitoring the overturning moment in use of the machine, in order that whilst the safe working load and boom length or maximum boom extension remain unchanged, and can both be employed at higher boom elevations, the acceptable overturning moment is not exceeded at lower elevations.

Such monitoring has been effected, in one known arrangement, utilising a resiliently supported pivot arm interposed between the boom and an elevating ram reacting against support structure of the machine base. That is to say, the pivot arm transmits load from the ram to the boom through a sprung connection. By means of a microswitch on the boom, operated by deflection of the pivot arm, control circuitry of the machine can be signalled electrically upon the load on the sprung connection exceeding a predetermined value, so to prevent further increase in the overturning moment by lowering or extension of the boom.

There are various weaknesses in the known system of that kind. In particular, whilst the angular relationship between the ram and the boom varies very little (in most lifting platform designs), the moment arm of the ram varies considerably as the boom is raised or lowered. Thus for a constant overturning moment of the boom and payload, measured about the boom's pivotal connection with the support structure, the ram load varies considerably with changing boom elevation. This variation in ram load at different elevations of the boom is not compensated for by the sprung connection mounted on the boom. Thus the limiting overturning moment allowed for by the sprung connection will be different for different boom elevations.

Additionally, the use of an electrical microswitch for signalling the machine to stop lowering or extending the boom has the disadvantage that it provides a sharp on/off signal, which can be inappropriate in view of the inertia of the large moving parts being controlled.

Other known systems for monitoring overturning moment use pressure in the elevating ram as a basis. This has the same geometrically imposed weakness as above and in addition is unreliable due to friction in the ram causing a significant proportion of the induced pressure.

It is an object of the present invention to provide load lifting apparatus having overturning moment monitoring means which is an improvement over such known systems as hereinbefore referred to.

In one of its aspects the invention provides load lifting apparatus comprising a boom carrying load bearing means at an outer end and being pivotally mounted at an inner end for movements of elevation and depression to raise and lower, respectively, the load bearing means, the boom being pivotally mounted at its inner end on support structure of the apparatus and the apparatus comprising an elevating ram arranged to act between the support structure and the boom to raise and lower the boom, the apparatus comprising monitoring means arranged to monitor the overturning moment of the boom and comprising a pivot arm which is pivotally mounted on the support structure, and to which a turning moment is applied by the ram in supporting the boom, and switching means arranged to be actuated as a consequence of movement of the arm against resilient supporting means upon a predetermined turning moment being exceeded.

In another of its aspects the invention provides load lifting apparatus comprising a boom carrying load bearing means at an outer end and being pivotally mounted at an inner end for movements of elevation and depression to raise and lower, respectively, the load bearing means, the boom being pivotally mounted at its inner end on support structure of the apparatus and the apparatus comprising an elevating ram arranged to act between the support structure and the boom to raise and lower the boom, the apparatus comprising monitoring means arranged to monitor the overturning moment of the boom and comprising a pivot arm which is pivotally mounted on the support structure, and to which a turning moment is applied by the ram in supporting the boom, and switching means arranged to be actuated as a consequence of deflection of the arm against resilient supporting means upon a predetermined turning moment being exceeded, the arrangement of the pivot arm being such that with variation of the boom elevation the load on said resilient supporting means remains substantially constant for a constant overturning of the boom.

In yet another of its aspects the invention provides load lifting apparatus comprising a boom carrying load bearing means at an outer end and being pivotally mounted at an inner end for movements of elevation and depression to raise and lower, respectively, the load bearing means, the boom being pivotally mounted at its inner end on support structure of the apparatus and the apparatus comprising an elevating ram arranged to act between the support structure and the boom to raise and lower the boom, the apparatus comprising monitoring means arranged to monitor the overturning moment of the boom and comprising a pivot arm which is pivotally mounted on the support structure, and to which a turning moment is applied by the ram in supporting the boom, and switching means arranged to be actuated as a consequence of deflection of the arm against resilient supporting means upon a predetermined turning moment being exceeded, the ram being coupled to the pivot arm at a position generally between the pivot axes of the pivot arm and the boom and said resilient supporting means comprising a spring pack secured to the support structure at a position generally between the pivot axes of the pivot arm and the boom for engagement by the arm at a distance from the pivotal coupling of the ram to the arm.

In yet another of its aspects the invention provides load lifting apparatus comprising an extensible boom carrying load bearing means at an outer end and being pivotally mounted at an inner end for movements of elevation and depression to raise and lower, respectively, the load bearing means, the boom being pivotally mounted at its inner end on support structure of the apparatus and the apparatus comprising a hydraulically actuated elevating ram arranged to act between the support structure and the boom to raise and lower the boom and a hydraulically actuated extending ram to extend and retract the boom, the apparatus comprising monitoring means arranged to monitor the overturning moment of the boom and comprising a pivot arm to which a turning moment is applied by the elevating ram in supporting the boom and switching means arranged to be actuated as a consequence of deflection of the pivot arm against resilient supporting means upon a predetermined turning moment being exceeded, said switching means comprising a diverter valve which when the switching means is actuated whilst the boom is being lowered diverts part at least of the ram-actuating fluid flow from the elevating ram to the extending ram to urge retraction of the boom.

There now follows a detailed description, to be read with reference to the accompanying drawings, of a lifting platform apparatus which illustrates the invention by way of example.

Figure 1A:
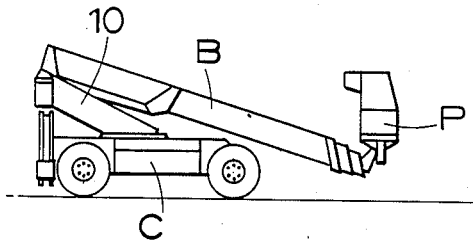
FIGS. 1A and 1B show the lifting platform apparatus in a road-going condition and in use, respectively.
Figure 1B:
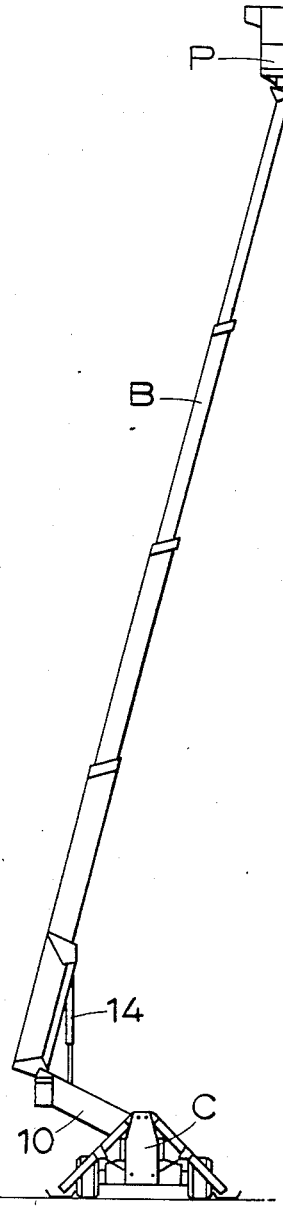

Lifting platform apparatus (FIGS. 1A and 1B) comprises a telescopically extensible boom B which at an outer end carries load bearing means in the form of an operator's platform P. The boom is pivotally mounted at an inner end on support structure 10 (comprising what is commonly known as an 'A' frame or superstructure), for movements of elevation and depression to raise and lower, respectively, the operator's platform. The support structure is swivel mounted, for rotation about a vertical axis, on a self-propelled wheeled chassis C. Such lifting platform apparatus, as so far described, is of a conventional kind.

Figure 2:
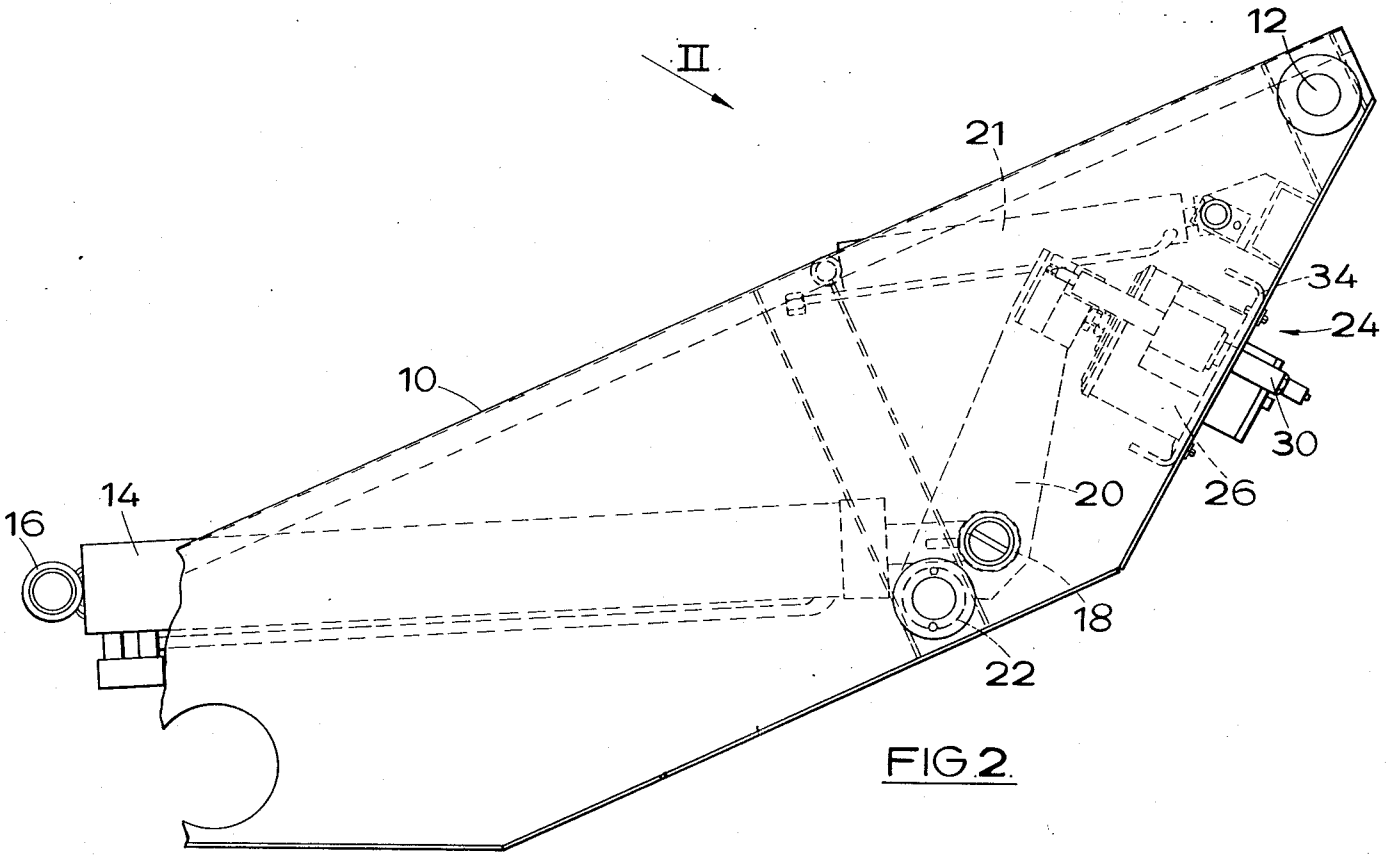
FIG. 2 is a view in side elevation of an upper end portion of support structure.
Figure 3:
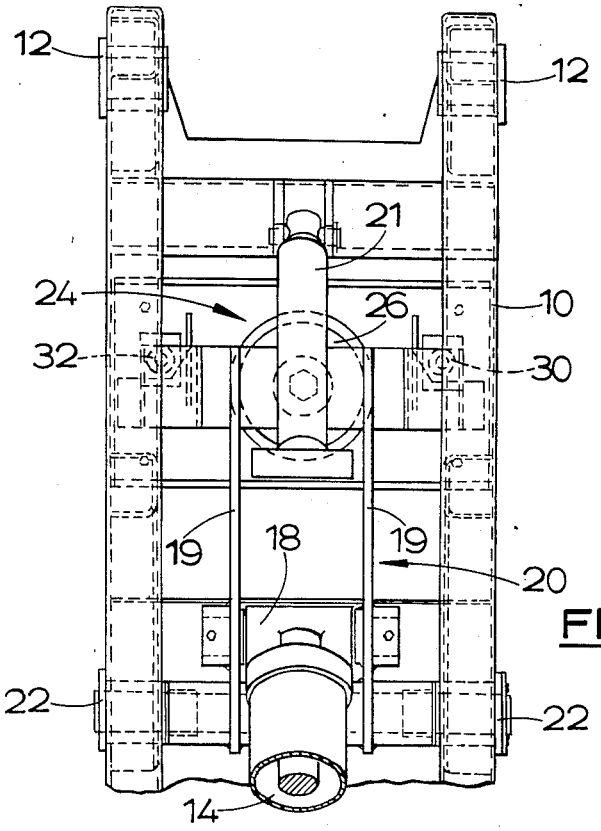
FIG. 3 is a view in the direction of arrow II in FIG. 2.

With reference to FIGS. 2 and 3, the support structure 10 of the illustrative lifting platform apparatus is arranged at horizontal bearing points 12 to support pivotally the inner end of the boom B. A double acting, hydraulic, elevating ram 14 (see also FIG. 1B) is arranged to act between the support structure 10 and the boom to raise and lower the boom. The ram 14 is coupled to the boom by means of an outer end pivotal coupling 16. By means of an inner end pivotal coupling 18, the opposite end of the ram is connected to and between parallel side plates 19 of a pivot arm 20 which is itself pivotally mounted on the support structure at horizontal bearing points 22. The pivotal coupling 18 of the ram 14 to the pivot arm 20 lies between the pivot axes of the pivot arm and the boom (at the bearing points 22 and 12 respectively) and can be adjusted to lie in the plane of those axes. A levelling cylinder 21 is connected between the support structure 10 and the boom to act as a master cylinder operating a slave cylinder which levels the operator's platform (in a known manner).

Figure 4:
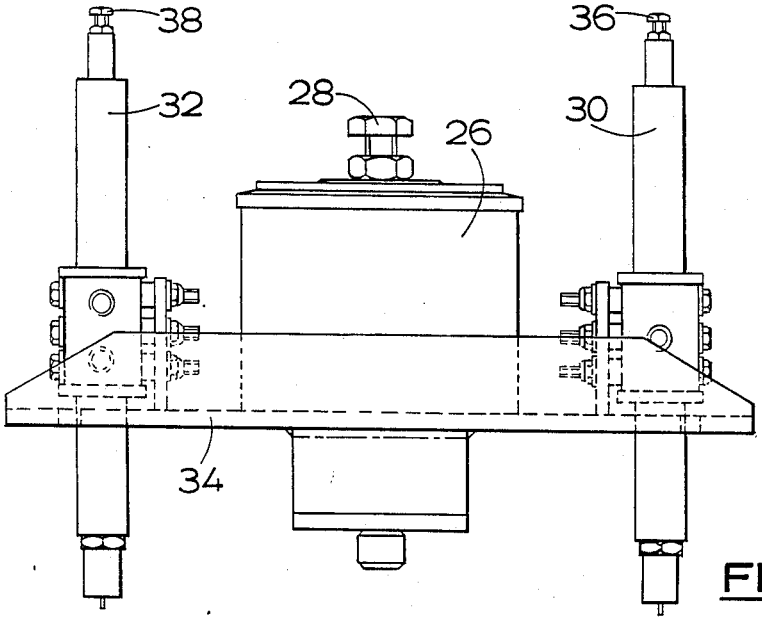
FIG. 4 illustrates a valves and spring pack assembly of monitoring means of the apparatus.

The pivot arm 20, through which the elevating ram 14 acts upon the support structure 10, forms part of a monitoring means arranged to perceive the overturning moment of the loaded boom in use of the machine. The monitoring means comprises also a valve and spring pack assembly 24 (see also FIG. 4) which is bolted to the support structure 10 adjacent to an outer end portion of the pivot arm 20, and a turning moment applied to the arm by the load on the elevating ram 14 is resisted by means of a spring pack 26 (of the assembly 24) against which the outer end portion of the arm bears; the arm actually bears against the head of a height-adjustable setting bolt 28 of the pack 26. The spring pack is pre-loaded in order that in normal operation of the machine the spring pack will not be deflected. However, should the overturning moment exceed a predetermined value, for example as the boom is lowered to one side of the machine, the pivot arm 20 will be deflected resiliently, resisted by the spring pack 26.

The valves and spring pack assembly 24 comprises also first and second hydraulic diverter valves 30 and 32, the precise function of which will be described hereinafter. The valves are arranged next to the spring pack 24 (on a common mounting plate 34) to be actuated by the outer end portion of the pivot arm 20 when the arm is deflected to a predetermined degree; the arm is arranged to engage height-adjustable setting bolts 36 and 38 of the valves. The valves form part of switching means of the monitoring means operative (as hereinafter described) to limit (and ultimately prevent) such further movements of the operator's platform as would increase the overturning moment.

Figure 5:
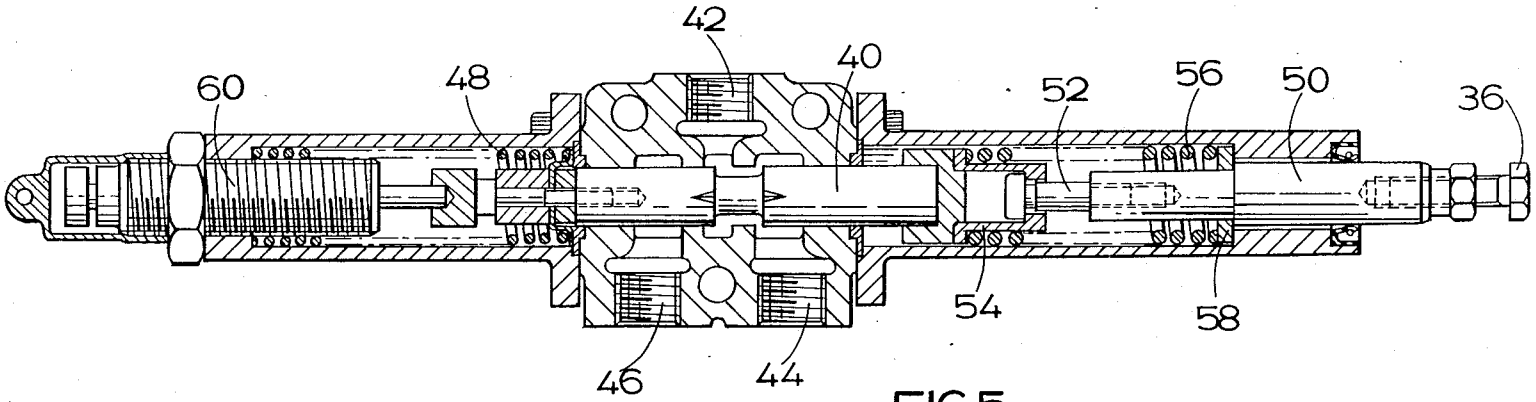
FIG. 5 illustrates a hydraulic diverter valve assembly of the monitoring means.

The two diverter valves are of the same construction, as illustrated in the case of the first valve 30 by FIG. 5. Each valve comprises a reciprocable spool 40 whch in an extreme right hand position (as shown in FIG. 5) permits a flow of hydraulic fluid under pressure from an inlet port 42 to a first outlet port 44 only, in an extreme left hand position permits flow from the inlet port 42 to a second outlet port 46 only, and in intermediate positions permits and proportions flow between the inlet port and both of the outlet ports. The spool is biased to its extreme right hand position by means of a compression coil spring 48 acting against its left hand end. The setting bolt 36, arranged to be engaged and depressed by the pivot arm 20, is secured in one end of a piston 50 arranged coaxially with the spool 40 to the right of the spool. A headed shoulder bolt 52 is secured in the opposite end of the piston 50. A peripherally flanged sleeve 54 is engaged beneath the head of the bolt 52 and a second compression coil spring 56 of the valve is maintained in compression between the flange of the sleeve 54 and a washer 58 abutting a leftwardly-facing shoulder of the piston 50. The assembly of the piston 50, the bolt 52, the sleeve 54, the spring 56 and the washer 58 is arranged to abut the right hand end of the spool 40.

Upon the piston 50 being urged leftwards, by the pivot arm 20 acting on the setting bolt 36, the spool 40 is urged leftwards by the sleeve 54. The first spring 48 is overcome without further compression of the second spring, owing to the pre-loading of the second spring 56, and the spool is moved leftwards. In order to damp out transient loadings on the piston, the spool 40 is arranged at its left hand end to engage a damping unit 60; the unit 60 so permits leftwards movement of the spool, progressively to close the first outlet port 44 and open the second outlet port 46, only in the event of a sustained load being exerted on the piston 50.

As constructed, the load necessary to move the spool 40 (leftwards) is applied by the sleeve 54, from the piston 50, by means of the second spring 56. Transient loadings can be absorbed by compression of that spring. Should the spring fail, in operation, the piston 50 can drive the shoulder bolt 52 through the sleeve 54 to engage the spool 40 directly.

Hydraulic circuitry associated with the monitoring means will now be described with reference to FIG. 6. The two diverter valves 30 and 32 are indicated on the drawing, as are the elevating ram 14 and a double-acting, hydraulic, extending ram 62 of the apparatus arranged to extend and retract the boom in a conventional manner. It is to be observed from FIG. 6 that in the case of the second diverter valve 32 one of its two outlet ports 44 is plugged.

The apparatus comprises three control valves for operation from the operator's platform; the valves are a boom elevation control valve 64, a boom extension control valve 66, and a slewing control valve 68 by means of which rotation of the support structure by a slewing motor 70 can be controlled.

Figure 6:
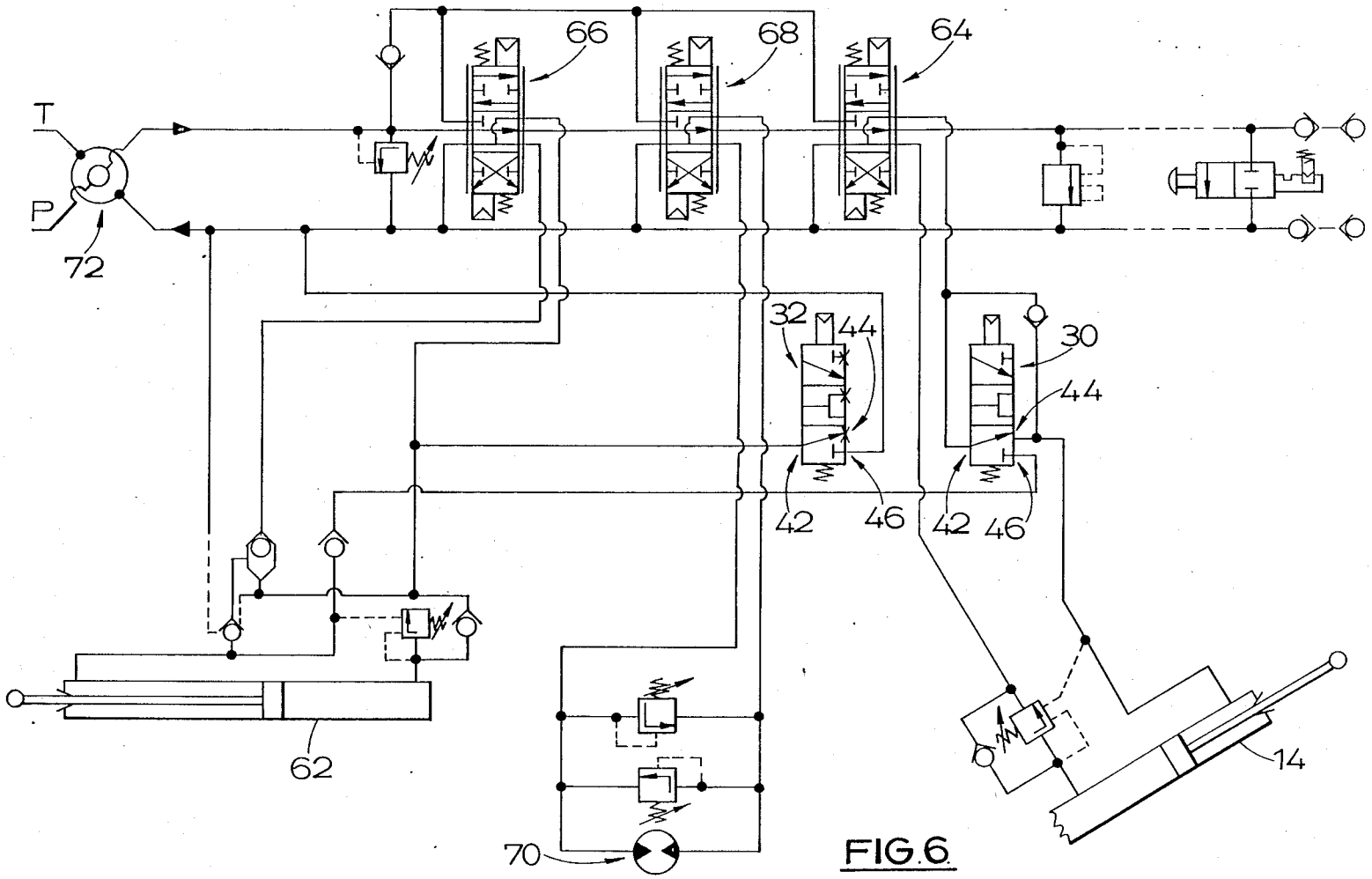
FIG. 6 is a hydraulic circuit diagram relating to automatic control of boom movements by the monitoring means.

With the valves 30 and 32 undepressed in normal operation of the machine (as shown in FIG. 6) the operation can cause the boom to be lowered by depressing the elevation control valve 64 from the neutral position illustrated in FIG. 6; fluid under pressure from a rotary distributor 72 passes to the inlet port 42 of the first diverter valve 30 and out through the first outlet port 44 to the annulus side of the elevating ram 14 to cause the boom to be lowered. Conversely, the boom is caused to be raised upon the elevation control valve 64 being raised from its neutral position.

The operator can cause the boom to be extended by depressing the extension control valve 66 from the neutral position illustrated; fluid under pressure passes directly to the cylinder side of the extending ram 62 to cause the boom to be extended. Conversely, the boom is caused to be retracted upon the extension control valve 66 being raised from its neutral position.

In the event that the overturning moment becomes excessive during lowering or extending of the boom, the pivot arm 20 actuates the two diverter valves 30 and 32 (the two being actuated simultaneously). The valve spools 40 become moved to their intermediate positions (in which fluid is distributed to both outlet ports 44 and 46). In the case of the first valve 30 the effect of this is that the flow of fluid passing to the annulus side of the elevating ram 14 (to lower the boom) becomes reduced, an increasing part of the fluid flow being diverted to the second outlet port 46 as the valve becomes further depressed. As can be seen from FIG. 6, the second port 46 is connected to the annulus side of the boom extending ram 62, pressure on which side acts to retract the boom. In the case of the second diverter valve 32, the effect is to bleed to tank fluid from the pressure supply line to the cylinder side of the extending cylinder 62 to the inlet port 42 of the diverter valve 32 is connected to that pressure supply line and the unplugged outlet port 46 is connected to tank. Accordingly, in this intermediate condition of the diverter valves, any attempt to lower the boom will meet with a reducing boom lowering performance (should the overturning moment continue to increase) and an increasing tendency for the boom to be retracted. Any attempt to extend the boom in the normal way will similarly meet with a reducing boom extending performance, until the stage is reached where the boom may be retracted owing to diverted fluid flow through the first diverter valve 30.

Should the situation not be corrected by the operator, to prevent a further increase in the overturning moment, the diverter valves 30 and 32 will become fully depressed by the pivot arm 20. In that condition of the first diverter valve 30, the first outlet port 44 of the valve is shut off by the spool 40, so preventing any further lowering of the boom. Furthermore, any attempt to lower the boom will result in retraction of the boom, owing to diversion of the full fluid flow to the second outlet port 46 connected to the annulus side of the extending ram 62. Any attempt to extend the boom will be ineffective since the pressure line to the extending ram 62 is then fully open to tank by way of the unplugged outlet port 46 of the second diverter valve 32.

An important aspect of the interaction of the elevating ram 14 with the pivot arm 20 on the support structure 10 is that the load on the spring pack 26 is substantially constant given a constant overturning moment on the boom about the bearing points 12 (that is, irrespective of the degree of boom elevation).

Figure 7:
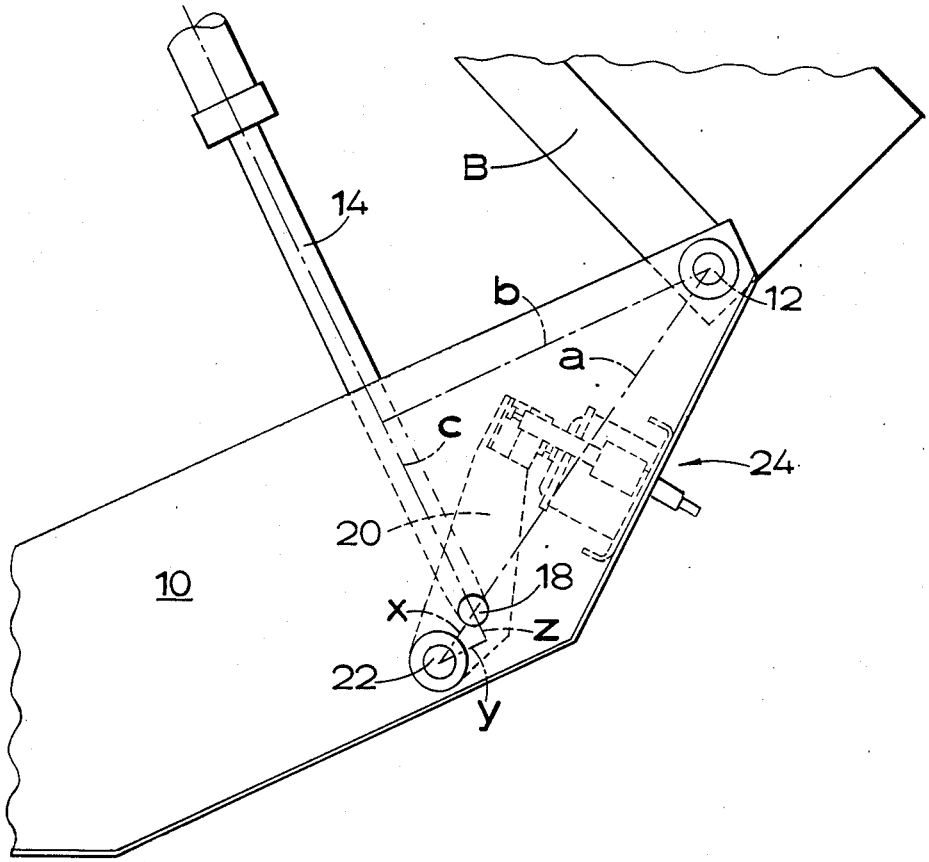
FIG. 7 is a diagram similar to the view of FIG. 2 but illustrating certain geometrical relationships.

This is due to the geometrical arrangement of the ram, boom and pivot arm within the support structure, and is illustrated by FIG. 7.

A constant overturning moment of the boom about the bearing points 12 results in different ram loads at different boom angles. However, by centring the inner end pivotal coupling 18 of the elevating ram 14 on the line joining the centres of the boom and pivot arm bearing points 12 and 22 the torque applied to the pivot arm 20, and so the load applied to the spring pack 26, can be made independent of the boom (and ram) inclination.

It can be seen that with suitable adjustment of the setting bolts 28, 36 and 38 the triangles comprising sides a, b, c, and x, y, z are similar, and remain so for all inclinations of the ram and boom.

For a torque $T_{(OT)}$ about pivot 12 the resulting ram load R is given by:

$$R = T_{(OT)}/b$$

The torque then induced in the arm measured about its pivot is given by:

$$T_{(ARM)} = R \cdot y = \frac{T_{(OT)} \cdot y}{b}$$

Now spring pack load, $L_s \alpha T_{(ARM)}$ $$L_s \, \alpha \, \frac{T_{(OT)} \cdot y}{b}$$

and as already stated $$y/b = \text{constant } K$$

Thus $L_s = K' \cdot T_{(OT)}$

That is to say, the load on the spring pack is directly proportional to the overturning moment of the boom and independent of boom elevation.

I claim:

1. Load lifting apparatus comprising an extensible boom carrying load bearing means at an outer end and being pivotally mounted at an inner end for movements of elevation and depression to raise and lower, respectively, the load bearing means, the boom being pivotally mounted at its inner end on support structure of the apparatus and the apparatus comprising a hydraulically actuated elevating ram arranged to act between the support structure and the boom to raise and lower the boom and a hydraulically actuated extending ram to extend and retract the boom, the apparatus comprising monitoring means arranged to monitor the overturning moment of the boom and comprising a pivot arm to which a turning moment is applied by the elevating ram in supporting the boom and switching means arranged to be actuated as a consequence of deflection of the pivot arm against resilient supporting means upon a predetermined turning moment being exceeded, said switching means comprising a diverter valve which when the switching means is actuated whilst the boom is being lowered, diverts at least part of the ram-actuating fluid flow from the elevating ram to the extending ram to urge retraction of the boom.

2. Apparatus according to claim 1 in which the pivot arm is pivotally mounted on the support structure and the elevating ram is pivotally coupled at its bottom end to the pivot arm.

3. Apparatus according to claim 2 in which the pivot arm engages height-adjustable means of a means resiliently supporting said pivot arm whereby the position of said pivotal coupling of the elevating ram to the pivot arm in normal use of the apparatus can be adjusted relative to the plane of the pivot axes of the pivot arm and the boom.

4. Apparatus according to claim 2 in which said resilient supporting means can be pre-loaded to determine the minimum pivot arm turning moment at which deflection of the arm will occur.

5. Apparatus according to claim 4 in which said resilient supporting means comprises a spring pack comprising a setting bolt engaged by the pivot arm and adjustable to vary the position of said pivotal coupling of the ram to the pivot arm relative to the plane of the pivot axes of the pivot arm and the boom.

6. Apparatus according to claim 2 in which the elevating ram is coupled to the pivot arm at a position between the pivot axes of the pivot arm and the boom, said resilient supporting means comprising a spring pack secured to the support structure at a position generally between the pivot axes of the pivot arm and the boom for engagement by the arm at a distance from the pivotal coupling of the ram to the arm.

7. Apparatus according to claim 1 in which the switching means comprises also a second diverter valve which when the switching means is actuated whilst the boom is being extended diverts at least part of the ram-actuating fluid flow from the extending ram to tank.

* * * * *